US007014528B2

(12) United States Patent
Mizutani et al.

(10) Patent No.: US 7,014,528 B2
(45) Date of Patent: Mar. 21, 2006

(54) GRINDING MACHINE AND GRINDING FLUID SUPPLY-NOZZLE THEREFOR

(75) Inventors: Yoshihiro Mizutani, Nishikasugai-gun (JP); Takayuki Yoshimi, Toyohashi (JP); Hiroshi Morita, Hoi-gun (JP)

(73) Assignee: Toyoda Koki Kabushiki Kaisha, Kariya (JP)

( * ) Notice: Subject to any disclaimer, the term of this patent is extended or adjusted under 35 U.S.C. 154(b) by 0 days.

(21) Appl. No.: 10/827,335

(22) Filed: Apr. 20, 2004

(65) Prior Publication Data

US 2004/0224612 A1 Nov. 11, 2004

(30) Foreign Application Priority Data

Apr. 25, 2003 (JP) ..... 2003-121492

(51) Int. Cl.
*B24B 1/00* (2006.01)

(52) U.S. Cl. ..... 451/7; 451/53; 451/488; 451/449

(58) Field of Classification Search ..... 451/7, 451/53, 449, 488, 450, 49, 242, 251, 246
See application file for complete search history.

(56) References Cited

U.S. PATENT DOCUMENTS

| | | | | | |
|---|---|---|---|---|---|
| 354,498 | A | * | 12/1886 | Kerchove | 407/11 |
| 2,434,679 | A | * | 1/1948 | Wagner et al. | 451/7 |
| 4,292,766 | A | * | 10/1981 | Kirk et al. | 451/11 |
| 4,314,425 | A | | 2/1982 | Bricker et al. | |
| 5,833,523 | A | * | 11/1998 | Hykes | 451/450 |
| 6,123,606 | A | * | 9/2000 | Hill et al. | 451/53 |

FOREIGN PATENT DOCUMENTS

| | | | | |
|---|---|---|---|---|
| DE | 198 49 025 A1 | | 4/2000 | |
| EP | 0 164 289 A1 | | 12/1985 | |
| EP | 0 791 432 A1 | | 8/1997 | |
| JP | 56-9166 | * | 1/1981 | 451/53 |
| JP | 2000-108032 | | 4/2000 | |

* cited by examiner

*Primary Examiner*—George Nguyen
(74) *Attorney, Agent, or Firm*—Oblon, Spivak, McClelland, Maier & Neustadt, P.C.

(57) ABSTRACT

It is one object of a grinding machine and a grinding fluid supply-nozzle therefor according to the present invention to supply grinding fluid to a moving grinding point reliably, even if the surfaces of a grinding wheel is abraded up.

A wheel head 5 advances/retracts to a workpiece. A grinding wheel G is carried rotatably by the wheel head 5 and grinds an eccentric portion W of the workpiece. A grinding fluid supply-nozzle 50 supplies grinding fluid to a moving grinding point K where the grinding wheel G contacts the eccentric portion W of the workpiece. The grinding fluid supply-nozzle 50 is made from a curve portion 53, an opening 51 and a straight portion 52 between the curve portion 53 and the opening 51. The grinding fluid supply-nozzle 50 spouts the grinding fluid to a grinding fluid supply point Pc upstream the grinding points K and Ks, even in the case that the grinding wheel G has been abraded up. Besides, the angle between the tangent of the grinding fluid supply point Pc and the grinding fluid spouted from the grinding fluid supply-nozzle 50 is smaller than a right angle.

10 Claims, 5 Drawing Sheets

GRINDING MACHINE AND GRINDING FLUID SUPPLY-NOZZLE THEREFOR

INCORPORATION BY REFERENCE

The present application claims priority under 35 U.S.C. §119 to Japanese Patent Application No. 2003-121492, filed on Apr. 25, 2003. The content of that application is incorporated herein by reference in their entirety.

BACKGROUND OF THE INVENTION

1. Field of the Invention

The present invention relates to a grinding machine which includes a nozzle for supplying grinding fluid or coolant to a grinding point where a grinding wheel contacts a workpiece. Hereinafter, "grinding fluid" represents each of the grinding fluid and the coolant.

2. Description of the Related Art

It is known for prior arts of a grinding machine shown in FIGS. 1(A) and 1(B), identified as first and second prior arts respectively. The grinding machine rotates a crankshaft W around the axis of a journal J of the crankshaft W, and grinds a revolving pin portion P of the crankshaft W by means of advancing/retracting a grinding wheel G adjusted to the eccentricity of the pin portion P by its revolution. Because of the revolution of the pin portion P corresponding to the rotational angle of the journal J, a grinding point K, where the grinding wheel G contacts the pin portion P, always moves according to the prior art of the grinding machine.

A nozzle 10 or 20 for supplying grinding fluid to the grinding point K is fixed on a wheel head 5 and advances/retracts therewith. The nozzle 10 shown in FIG. 4(A), called "straight-nozzle", directly supplies the grinding fluid to the grinding point K of which pin portion P exists at the angle of 0 degree or 180 degrees across the direction of movement of the grinding wheel G at a right angle. The nozzle 20 shown in FIG. 4(B), called "right angle-nozzle", supplies the grinding fluid to the surface of the grinding wheel G at a right angle upstream the grinding point K and pastes the fluid on the surface of the grinding wheel G. However, since the grinding point K moves as shown in FIGS. 4(A) and 4(B) by the revolving pin portion P, fixed straight-nozzle 10 or right angle-nozzle 20 hardly supplies enough grinding fluid to the moving grinding point K thereby to supply large quantities of the fluid thereto.

To resolve the above-mentioned problem, third prior art is proposed, Japanese Patent Laid Open No. 2000-108032 shown in FIG. 5, of which object is to supply the grinding fluid as small quantities as possible to the grinding point K and to cool down thereat efficiently. According to this prior art, two nozzles, the straight-nozzle 10 and the right angle-nozzle 20, are disposed on the wheel head 5 so that the nozzles 10, 20 advance/retract therewith. The straight-nozzle 10 directly supplies the grinding fluid to the grinding point K at which the grinding wheel G contacts the workpiece W, and the right angle-nozzle 20 supplies the grinding fluid to the surface of the grinding wheel G at a right angle upstream the grinding point K.

According to the third prior art, the wheel head 5 advances/retracts with both of the straight-nozzle 10 and the right angle-nozzle 20 in order to supply the grinding fluid as small quantities as possible. However, where the diameter of the grinding wheel G has become smaller because of its abrasion in relation to grinding, the grinding point K shifts so that the straight-nozzle 10 hardly supplies the grinding fluid thereto. Further, enough grinding fluid may not be supplied to the grinding point K by the straight-nozzle 10 because of the resistance of air flow following the surface of the grinding wheel G, unless the grinding fluid to be supplied is pressurized. Thus, a grinding fluid supply source has to become larger in order to supply large quantities of the grinding fluid or higher in pressure to pressurize the fluid to be supplied.

Further according to the third prior art, the right angle-nozzle 20 is mounted at a height in the machine to prevent the workpiece W or a jig from interfering, so that there exists a long distance between the grinding point K and the surface of the grinding wheel G where the grinding fluid is supplied. Therefore, large quantities of the grinding fluid are supplied to the grinding point K in order to compensate for insufficiency of the supply quantities relative to the position of the nozzle 20. Furthermore, bending the tip of the nozzle 20 at an angle of 90 degrees, the flow of the grinding fluid through the nozzle 20 falls into disorder so that the grinding fluid splashes radially at the opening of the nozzle 20 when the fluid has spouted. Thus, it costs to provide a facility to reduce the mist of the splashed grinding fluid. Moreover, since the grinding fluid spouts from the right angle-nozzle 20 to the abrasive surface of the grinding wheel G at a right angle, the rotation of the grinding wheel G is disturbed by right angle-fluid so as to increase torque of a motor attached to a spindle of the grinding wheel G.

SUMMARY OF THE INVENTION

In view of the previously mentioned circumstances, it is an object of the present invention to provide a grinding machine and a grinding fluid supply-nozzle therefor which can reduce grinding fluid, even if a grinding point shifts in relation to rotation of a workpiece or abrasion of a surface of the grinding wheel.

It is second object of the present invention to provide a grinding machine which is able to reduce torque of a motor attached to a spindle of a grinding wheel and a grinding fluid supply-nozzle therefor.

It is third object of the present invention to provide a grinding machine which is able to minimize a grinding fluid supply source and a grinding fluid supply-nozzle therefor.

It is fourth object of the present invention to provide a grinding machine which is able to reduce cost for a facility to reduce mist of the grinding fluid and a grinding fluid supply-nozzle therefor.

In order to achieve the above and other objects, the present invention provides a grinding machine comprising:

a work spindle for rotating a journal portion of a workpiece;

a wheel head for advancing/retracting to said workpiece;

a grinding wheel carried rotatably by said wheel head and for grinding an eccentric portion of said workpiece; and a grinding fluid supply-nozzle for supplying grinding fluid to a grinding point where said grinding wheel contacts said eccentric portion of said workpiece;

wherein said grinding point moves from a plane including axes of said work spindle and said grinding wheel;

wherein said grinding fluid supply-nozzle is made from a curve portion, an opening and therebetween a straight portion;

wherein said grinding fluid supply-nozzle spouts said grinding fluid to a grinding fluid supply point maintained its position upstream said grinding point, even in the case that said grinding wheel has been abraded up; and wherein the angle between the tangent of said grinding fluid supply point and said grinding fluid spouted from said grinding fluid supply-nozzle is smaller than a right angle.

Second aspect of the present invention is that the grinding machine comprises:

a work spindle for rotating a journal portion of a workpiece;

a wheel head for advancing/retracting to said workpiece;

a grinding wheel carried rotatably by said wheel head and for grinding an eccentric portion of said workpiece; and a grinding fluid supply-nozzle for supplying grinding fluid to a grinding point where said grinding wheel contacts said eccentric portion of said workpiece;

wherein said grinding point moves from a plane including axes of said work spindle and said grinding wheel;

wherein said grinding fluid supply-nozzle is made from a curve portion and a taper portion;

wherein said grinding fluid supply-nozzle spouts said grinding fluid to a grinding fluid supply point maintained its position upstream said grinding point, even in the case that said grinding wheel has been abraded up; and wherein the angle between the tangent of said grinding fluid supply point and said grinding fluid spouted from said grinding fluid supply-nozzle is smaller than a right angle.

Third aspect of the present invention is that a grinding fluid supply-nozzle for a grinding machine comprising a curve portion, an opening and therebetween a straight portion; and wherein said grinding fluid supply-nozzle supplies grinding fluid to a grinding point where a grinding wheel contacts an eccentric portion of a workpiece;

wherein said grinding point moves from a plane including rotational axes of said workpiece and said grinding wheel;

wherein said grinding fluid supply-nozzle spouts said grinding fluid to a grinding fluid supply point maintained its position upstream said grinding point, even in the case that said grinding wheel has been abraded up; and wherein the angle between the tangent of said grinding fluid supply point and said grinding fluid spouted from said grinding fluid supply-nozzle is smaller than a right angle.

Forth aspect of the present invention is that a grinding fluid supply-nozzle for a grinding machine comprising a curve portion and a taper portion; and wherein said grinding fluid supply-nozzle supplies grinding fluid to a grinding point where a grinding wheel contacts an eccentric portion of a workpiece;

wherein said grinding point moves from a plane including rotational axes of said workpiece and said grinding wheel;

wherein said grinding fluid supply-nozzle spouts said grinding fluid to a grinding fluid supply point maintained its position upstream said grinding point, even in the case that said grinding wheel has been abraded up; and wherein the angle between the tangent of said grinding fluid supply point and said grinding fluid spouted from said grinding fluid supply-nozzle is smaller than a right angle.

BRIEF DESCRIPTION OF THE DRAWINGS

Various other objects, features and many of the attendant advantages of the present invention will be readily appreciated as the same becomes better understood by reference to the following detailed description of the preferred embodiments when considered in connection with the accompanying drawings, in which.

DETAILED DESCRIPTION OF THE PREFERRED EMBODIMENTS

Figure 1A:
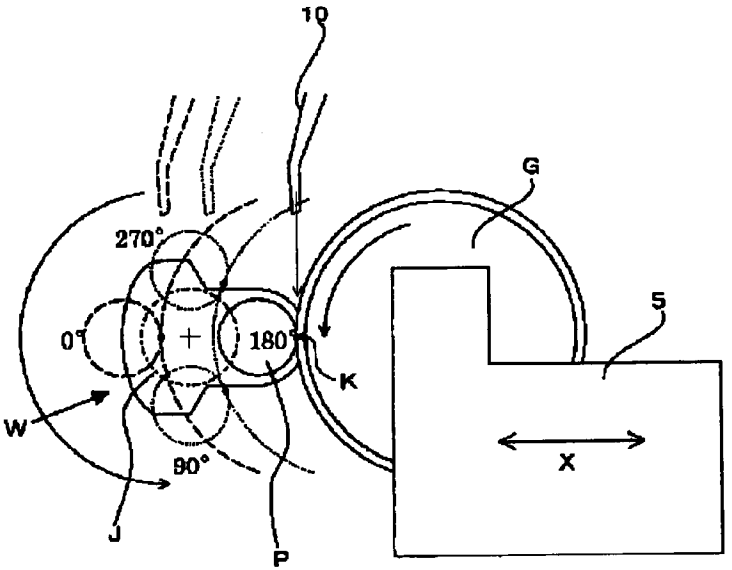
PRIOR ART Fig. 1(A)
FIG. 1(A) is an outline of a side view of a grinding machine according to first prior art.
Figure 1B:
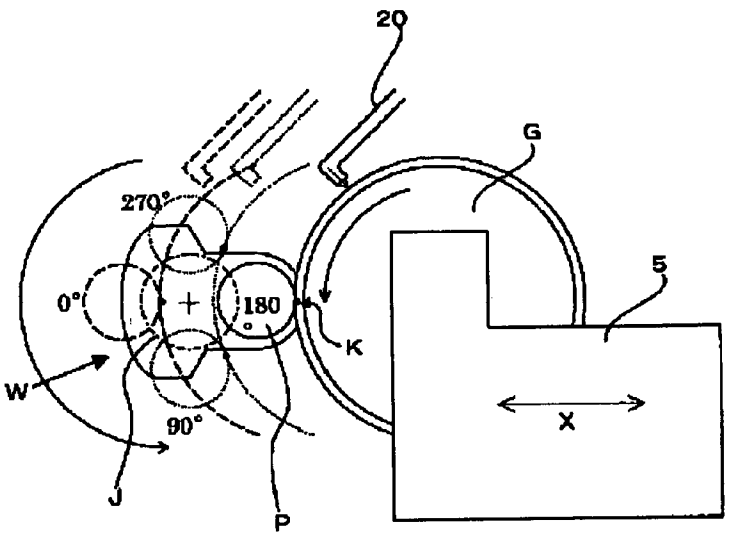
PRIOR ART Fig. 1(B)
FIG. 1(B) is an outline of a side view of a grinding machine according to second prior art.
Figure 2:
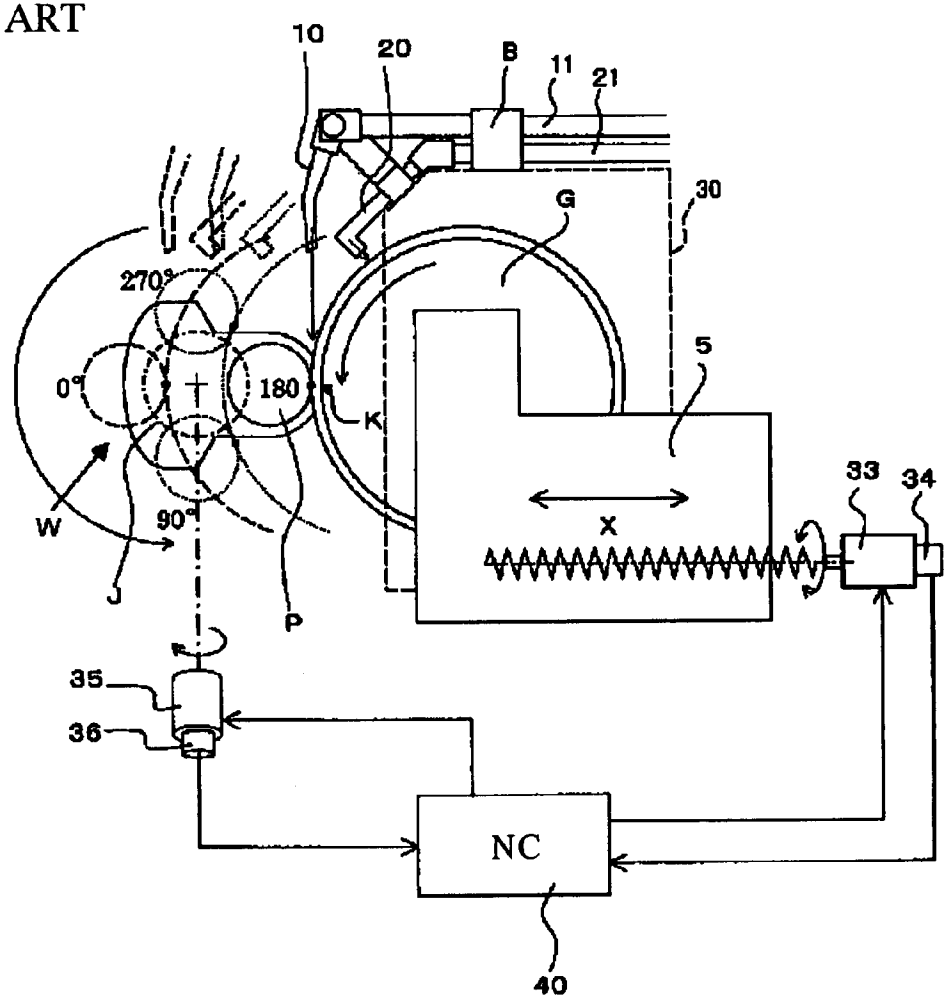
PRIOR ART Fig. 2
FIG. 2 is an outline of a side view of a grinding machine according to third prior art.
Figure 3:
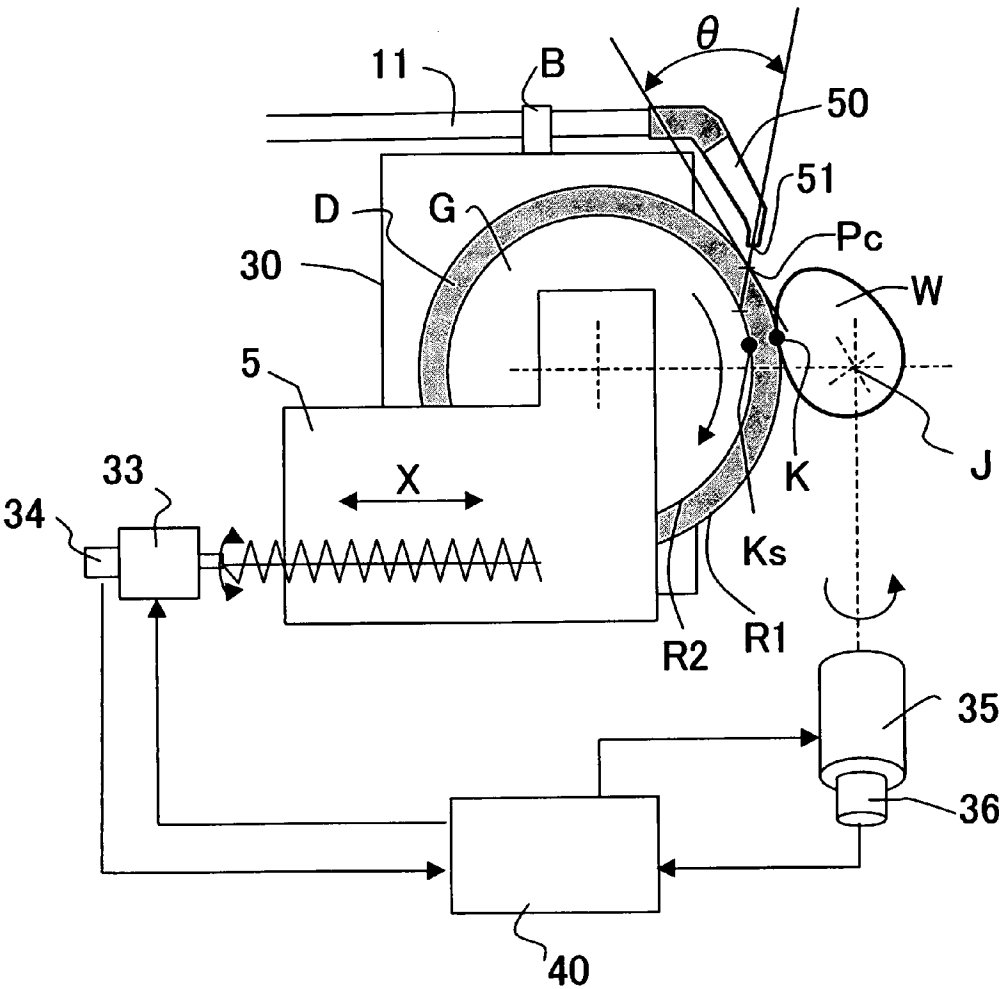
FIG. 3 is an outline of a side view of a grinding machine according to the present invention.

A preferred embodiment of a grinding machine according to the present invention will be described referring to FIG. 3 which shows an outline of a side view of the grinding machine according to the present invention. As shown in FIG. 3, a work spindle rotates a workpiece of a camshaft including at least one cam lobe W and one journal portion, and the cam lobe W is ground by grinding wheel G, rotating opposite direction to that of the workpiece, attached to a wheel head 5.

Each end of the workpiece of the camshaft is clamped by chucks or centers attached to the work spindle of a work head and a tail spindle of a tail stock. A motor 35 attached to the work spindle rotates the camshaft around the axis J of the journal portion. The wheel head 5 rotatablely carries the grinding wheel G and advances/retracts by a motor 33 along a horizontal X-axis transverse to the axis of the work spindle at a right angle. The motor 33 is adjusted to the angle of the motor 35 equivalent to the angle of the cam lobe W. The motors 35 and 33 respectively carry encoders 36 and 34. The motors 35, 33 and encoders 36, 34 are connected to a numerical controller 40. The numerical controller 40 synchronously controls both of the motors 35, 33 so that the wheel head 5 advances/retracts in simultaneous relation to the angle phase of the cam lobe W, whereby the cam lobe W is ground into non-cylindrical and eccentric profile.

A wheel guard 30 is mounted on the wheel head 5 in order to guard the grinding wheel G and is equipped with a pipe 11 via a bracket B. The pipe 11 connects a grinding fluid supply source, not shown, with a grinding fluid supply-nozzle 50. To reduce quantities of the grinding fluid to be supplied to the grinding point K, the grinding fluid is reliably supplied to the grinding point K, however the grinding point K moves according to the cam grinding according to the embodiment. The profile of the cam lobe W is made from base-circle portion and lift portion. While the base-circle portion is ground, the grinding point K is positioned in the horizontal plane including the axis of the work spindle and the axis of grinding wheel G. And, while the lift portion is ground, the grinding point K is positioned above the horizontal plane.

One factor in the up/down movement of the grinding point K is the profile of the cam lobe W. Another factor is reduction of the diameter of the grinding wheel G because of abrasion or truing. To these factors in the up/down movement of the grinding point K, the straight-nozzle 10 of the first prior art is hardly accommodated. Thus, the grinding fluid supply-nozzle 50 of the embodiment needs to be fixed as a grinding fluid supply point Pc, where the spouted grinding fluid reaches the abrasive surface of the grinding wheel G, is positioned upstream the grinding point K. Further, the grinding fluid supply-nozzle 50 of the embodiment is fixed to be able to supply grinding fluid to the grinding fluid supply point Pc upstream to the grinding point K to prevent the grinding wheel G, the workpiece W, the jig, etc. from interfering. Considering this interfering, the right angle-nozzle 20 of the second prior art has to be positioned pretty upstream the grinding point K so as to need to spout large quantities of the grinding fluid to be supplied thereto reliably. In contrast, the grinding fluid supply-nozzle 50 of the embodiment is able to supply the grinding fluid to the grinding point K reliably and to spout the grinding fluid in one direction, not to splash radially as explained hereinafter detailed.

The grinding fluid supply-nozzle 50 forms an opening 51 in order to spout the grinding fluid to the grinding fluid supply point Pc at the angle θ which is smaller than a right angle and equals to 30 degrees in the embodiment. There is disposed the grinding fluid supply-nozzle 50 which spouts the grinding fluid to the grinding fluid supply point Pc, not to be obstructed by the workpies W, etc. The tip of the grinding fluid supply-nozzle 50 is laid down than that of the right angel-nozzle 20 of the prior art, whereby the downward space beside the tip of the grinding fluid supply-nozzle 50 becomes larger than that of the right angle-nozzle 20 of the prior art. Therefore, the grinding fluid supply-nozzle 50 can be positioned closer to the grinding point K than the right angle-nozzle 20 of the prior art without being obstructed by the workpies W, etc.

The position of the grinding fluid supply point Pc is determined on the surface of the grinding wheel G and upstream the grinding point K, which moves up and down, about the rotational direction of the grinding wheel G. Even in the case of the minimum diameter of the grinding wheel G where the grinding wheel has been abraded up, it is determined that the position of the grinding fluid supply point Pc is maintained upstream the grinding point Ks about the rotational direction of the grinding wheel G. Therefore, the grinding fluid supply point Pc is always positioned upstream the grinding points, between the grinding point K in maximum diameter of the grinding wheel G and the grinding point Ks in minimum diameter of the same, about the rotational direction of the grinding wheel G.

Figure 4B:
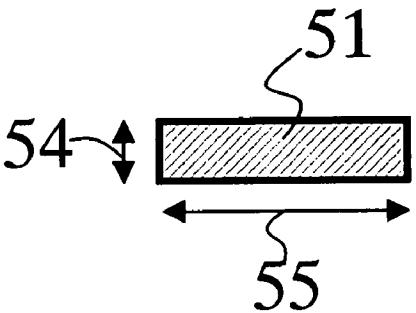
FIG. 4(B) is a section view of a spout of the grinding fluid supply-nozzle shown in FIG. 4(A)
Figure 4A:
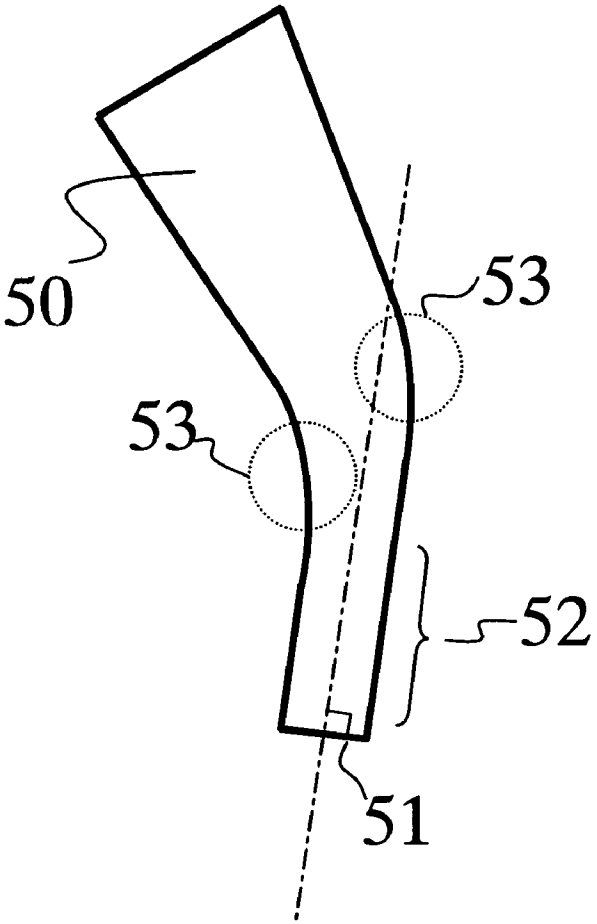
FIG. 4(A) is a side view of a grinding fluid supply-nozzle attached to the grinding machine according to first embodiment of the present invention.
Figure 5B:
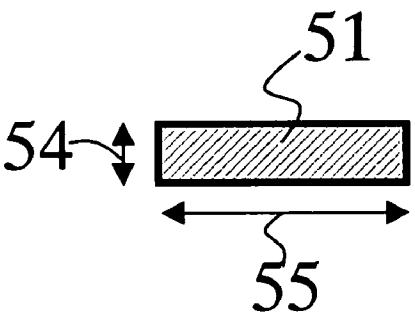
FIG. 5(B) is a section view of a spout of the grinding fluid supply-nozzle shown in FIG. 5(A).
Figure 5A:
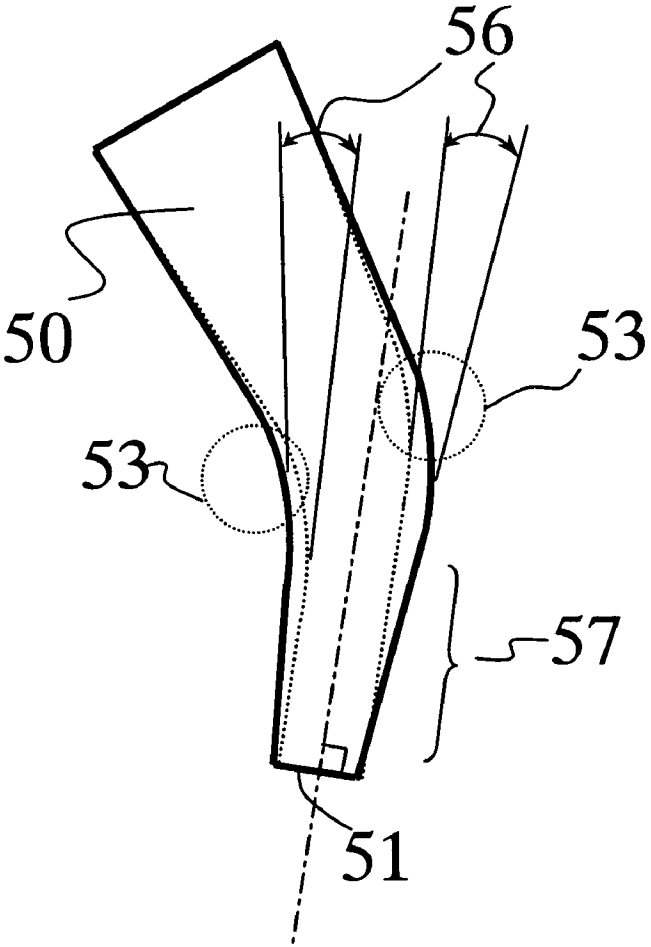
FIG. 5(A) is a side view of a grinding fluid supply-nozzle attached to the grinding machine according to second embodiment of the present invention.

First and second embodiments of the profile of the grinding fluid supply-nozzle 50 will be described hereinafter with referring to FIGS. 4(A)/4(B) and 5(A)/5(B), respectively. Each of FIGS. 4(A) and 4(B) shows the first embodiment of the grinding fluid supply nozzle 50, wherein FIG. 4(A) shows its side view and FIG. 4(B) shows the section view of the opening 51 thereof. Similarly, each of FIGS. 5(A) and 5(B) shows the second embodiment of the grinding fluid supply nozzle 50, wherein FIG. 5(A) shows its side view and FIG. 5(B) shows the section view of the opening 51 thereof.

In the first embodiment as shown in FIG. 4(A), the grinding fluid supply-nozzle 50 is made from the opening 51, a straight portion 52 of which tip forms the opening 51, and a curve portion 53 between the straight portion 52 and the opening 51. The straight portion 52 provides uniform flow not to splash radially, where the opening 51 spouts the grinding fluid to the grinding fluid supply point Pc. The curve portion 53 makes the grinding fluid flow smoothly and in order, thereby to change flowing direction gradually. The section of the straight portion 52 or opening 51 in FIG. 4(B) forms a rectangle of which longer sides 55 are as long as the width of the grinding wheel G about its axis. And, the length of the straight portion 52 is about 10 millimeters.

According to the above-mentioned grinding fluid supply-nozzle 50 of the first embodiment, the grinding fluid is supplied through the pipe from the grinding fluid supply source, not shown, to the grinding fluid supply point Pc. In the grinding fluid supply-nozzle 50, the grinding fluid flows into the straight portion 52 not to be in disorder by passing through the curve portion 53 and spouts from the opening 51 to the grinding fluid supply point Pc. Therefore, the grinding fluid spouts to the grinding fluid supply point Pc reliably, does not splash radially.

Next, the grinding fluid supply nozzle according to the second embodiment will be described with referring to FIGS. 5(A) and 5(B). In the second embodiment as shown in FIG. 5(A), the grinding fluid supply-nozzle 50 is made from the opening 51, a taper portion 57 which tapers off to its tip of the opening 51, and a curve portion 53 between the opening 51 and the taper portion 57. The taper portion 57 provides uniform and faster flow not to splash radially, where the opening 51 spouts the grinding fluid to the grinding fluid supply point Pc. The curve portion 53 makes the grinding fluid flow smoothly and in order, thereby to change flowing direction gradually. The section of the opening 51 in FIG. 3(B) forms a rectangle of which longer sides 55 are as long as the width of the grinding wheel G about its axis. And, in the section of the taper portion 57, the shorter sides of the rectangle taper off to the tip of the taper portion 57 at a forty-degree angle or less (each of numerals 56 indicates twenty-degree angle or less).

According to the above-mentioned grinding fluid supply-nozzle 50 of the second embodiment, the grinding fluid is supplied through the pipe from the grinding fluid supply source, not shown, to the grinding fluid supply point Pc. In the grinding fluid supply-nozzle 50, the grinding fluid flows into the taper portion 57 not to be in disorder by passing through the curve portion 53 and accelerates in the taper portion 57, and then spouts from the opening 51 to the grinding fluid supply point Pc. Therefore, the grinding fluid spouts to the grinding fluid supply point Pc reliably, does not splash radially. Besides, the taper portion 57 makes the flow-speed of the grinding fluid be faster so that the flow-speed of the spouted grinding fluid becomes faster, whereby it becomes easier to break the air-flow following the rotating grinding wheel G and to supply the grinding fluid to the grinding point K without reducing the rotation force of the grinding wheel G.

In the first and second embodiments, the flow-speed of the spouted grinding fluid from the opening 51 needs to break the air-flow following the grinding wheel G and is faster than the speed calculated by Bernoulli's Equation. Now, Vc, Va, ρa, ρc and θ respectively represent;

Vc: the flow-speed of the grinding fluid,

Va: the air-flow-speed following the grinding wheel G,

ρa: the density of the air in one atmospheric pressure and twenty degrees centigrade, ρc: the density of the grinding fluid in one atmospheric pressure and twenty degrees centigrade, and θ: the angle between the tangent at the grinding fluid supply point Pc and the direction of the grinding fluid spouted from the grinding fluid-supply nozzle 50. The flow-speed of the grinding fluid Vc is calculated by the below-indicated inequality.

$$Vc \cdot \sin\theta > Va(\rho a/\rho c)^{1/2}$$

The direction of the extending line of the spouted grinding fluid crosses the plane including the axes of the work spindle and the grinding wheel G at near side of the workpiece W than the axis of the grinding wheel G, namely the angle θ is smaller than a right angle as explained in prior arts. Now, where Va, ρa, ρc and θ respectively determine 110 m/s, 0.1229 $kgf \cdot s^2/m^4$, 101.79 $kgf \cdot s^2/m^4$ and 30 degrees, it is calculated that the flow-speed of the grinding fluid Vc is more than 7.6 m/s to break the air-flow following the grinding surface of the grinding wheel G.

On the other hand, the quantities of the grinding fluid are calculated by the product of the flow-speed of the grinding fluid and the cross section-area of the opening 51. Where the flow-speed of the grinding fluid and the cross section-area of the opening 51 respectively determine 7.6 m/s and 60 $mm^2$ (in the case that its height is 3 millimeters and width is 20 millimeters), the quantities of the grinding fluid are about 28 litters per minutes. Therefore, to break the air-flow of the grinding fluid following the grinding wheel G and to supply the grinding fluid to the grinding point K and Ks, the quantities of the grinding fluid are set more than 28 litters per minutes.

In the above-mentioned condition (Va=110 m/s, ρa=0.1229 $kgf \cdot s^2/m^4$ and ρc=101.79 $kgf \cdot s^2/m^4$), it is known that the third prior art of FIG. 5 with the straight-nozzle 10 and the right angle-nozzle 20 require a hundred and a few tens litters per minutes. According to the embodiments of the present invention, however, the quantities of the grinding fluid are able to reduce substantially. In addition, since the direction of the spouted grinding fluid leans to the rotational direction of the grinding wheel G, the motor torque of the wheel spindle reduces substantially.

Although the embodiments of the present invention indicate the grinding machine for grinding the cam lobe of the camshaft, it is possible to accommodate to the grinding machine for grinding an eccentric portion, for example a crankpin portion of a crankshaft, an offset rotor portion of a shaft of a compressor.

While the invention has been described in detail with reference to the preferred embodiments, it will be apparent to those skilled in the art that the invention is not limited to the present embodiments, and that the invention may be realized in various other embodiments within the scope of the claims.

What is claimed is:

1. A grinding machine comprising:

a work spindle for rotating a workpiece having an eccentric portion;

a wheel head mounted for advancing/retracting relative to said workpiece;

a grinding wheel carried rotatably by said wheel head and for grinding the eccentric portion of said workpiece;

a grinding fluid supply-nozzle for supplying grinding fluid to a moving grinding point where said grinding wheel contacts said eccentric portion of said workpiece by discharging grinding fluid to a position upstream of the moving grinding point, wherein said grinding fluid supply-nozzle is made from a curve portion, an opening and therebetween a straight portion, and wherein the angle between the tangent of said grinding fluid supply point and said grinding fluid spouted from said grinding fluid supply-nozzle is smaller than a right angle; and means for advancing/retracting said wheel head relative to said workpiece in synchronism with movement of said eccentric portion.

2. A grinding machine according to claim 1, wherein the section of said straight portion of said grinding fluid supply-nozzle forms a rectangle and maintains its rectangular shape at least 10 millimeters.

3. A grinding machine according to claim 1, wherein said workpiece is a camshaft and said eccentric portion is a cam lobe.

4. A grinding machine according to claim 1, wherein said workpiece is a crankshaft and said eccentric portion is a crankpin portion.

5. A grinding machine according to claim 1, wherein said workpiece is a shaft of a compressor and said eccentric portion is a rotor portion.

6. A grinding machine comprising:

a work spindle for rotating a workpiece having an eccentric portion;

a wheel head mounted for advancing/retracting relative to said workpiece;

a grinding wheel carried rotatably by said wheel head and for grinding the eccentric portion of said workpiece;

a grinding fluid supply-nozzle for supplying grinding fluid to a moving grinding point where said grinding wheel contacts said eccentric portion of said workpiece by discharging grinding fluid to a position upstream of the moving grinding point, wherein said grinding fluid supply-nozzle is made from a curve portion and a taper portion, and wherein the angle between the tangent of said grinding fluid supply point and said grinding fluid spouted from said grinding fluid supply-nozzle is smaller than a right angle; and means for advancing/retracting said wheel head relative to said workpiece in synchronism with movement of said eccentric portion.

7. A grinding machine according to claim 6, wherein the section of said taper portion of said grinding fluid supply-nozzle forms a rectangle and wherein said taper portion tapers off to its tip at a forty-degree angle or less.

8. A grinding machine according to claim 6, wherein said workpiece is a camshaft and said eccentric portion is a cam lobe.

9. A grinding machine according to claim 6, wherein said workpiece is a crankshaft and said eccentric portion is a crankpin portion.

10. A grinding machine according to claim 6, wherein said workpiece is a shaft of a compressor and said eccentric portion is a rotor portion.

* * * * *